US007552485B1

(12) United States Patent
Harrison, Jr.

(10) Patent No.: US 7,552,485 B1
(45) Date of Patent: Jun. 30, 2009

(54) TOILET SEAT GRIPPING APPARATUS

(76) Inventor: Willie E. Harrison, Jr., 2263 Cortland Rd., Detroit, MI (US) 48206

( * ) Notice: Subject to any disclaimer, the term of this patent is extended or adjusted under 35 U.S.C. 154(b) by 374 days.

(21) Appl. No.: 11/414,321

(22) Filed: May 1, 2006

(51) Int. Cl.
*A47K 13/10* (2006.01)

(52) U.S. Cl. ..... 4/246.1

(58) Field of Classification Search ..... 4/246.1
See application file for complete search history.

(56) References Cited

U.S. PATENT DOCUMENTS 2,758,315 A * 8/1956 Hylton ..... 4/246.1
D314,322 S 2/1991 Burghoff
5,027,472 A * 7/1991 Goodman ..... 16/422
5,086,523 A 2/1992 De Mott et al.
5,511,252 A 4/1996 Kreemer
5,727,258 A 3/1998 Derouin
5,963,992 A 10/1999 Bonner
6,691,330 B2 * 2/2004 Baker ..... 4/246.1
6,842,916 B1 1/2005 Gunn et al.

* cited by examiner

*Primary Examiner*—Charles E. Phillips

(57) ABSTRACT

A toilet seat gripping apparatus includes a panel that has a top side, a bottom side, a forward edge and a rear edge. The rear edge is concavely arcuate between opposite ends of the rear edge. The rear edge is contoured to an outer edge of a toilet seat. A pair of gripping members is provided. Each of the gripping members is coupled to the panel and releasably couples the panel to the toilet seat. The panel extends outwardly from the outer edge of the toilet seat.

6 Claims, 3 Drawing Sheets

FIG. 1
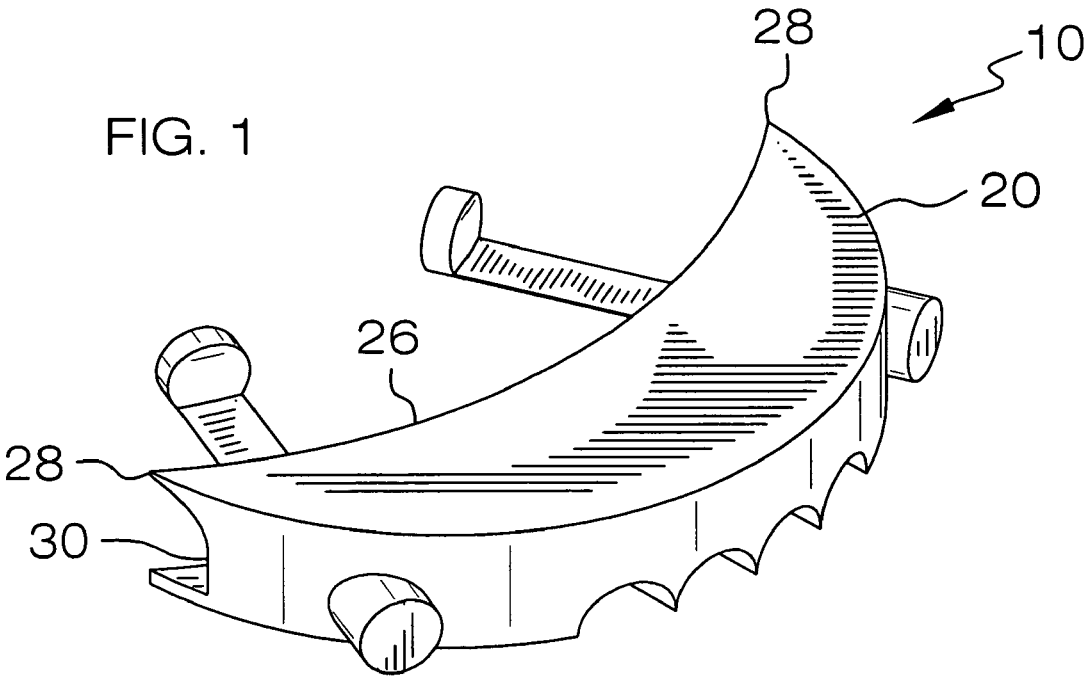
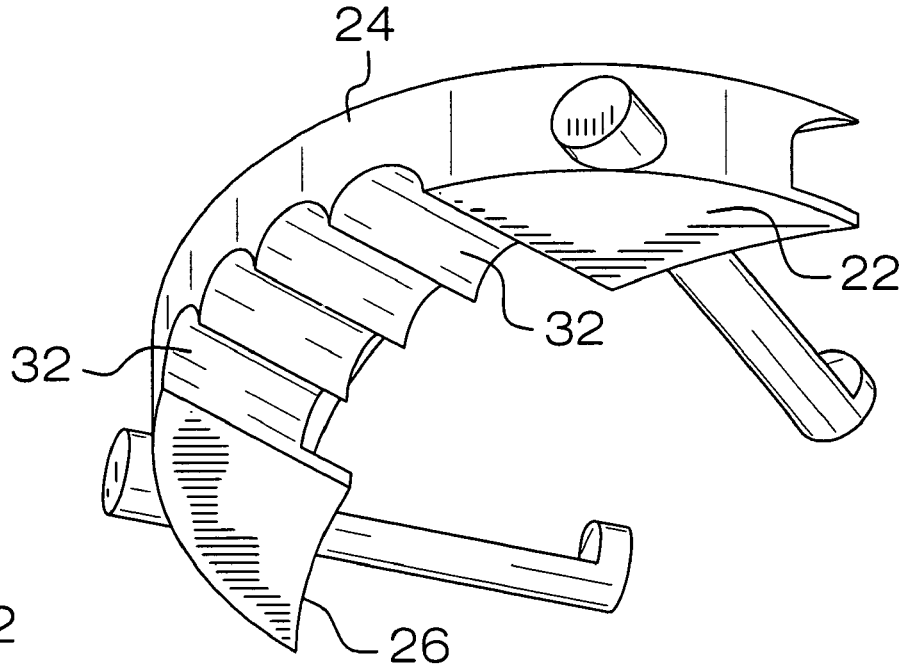
FIG. 2

TOILET SEAT GRIPPING APPARATUS

BACKGROUND OF THE INVENTION

1. Field of the Invention

The present invention relates to toilet seat grips and more particularly pertains to a new toilet seat grip for gripping a toilet seat so that the toilet seat may be lifted and lowered without having to touch the toilet seat.

2. Description of the Prior Art

The use of toilet seat grips is known in the prior art. While these devices fulfill their respective, particular objectives and requirements, the need remains for a device that allows a person to lift and lower a toilet seat in such a manner that the toilet seat not need to be touched. Further, the device should easily retrofittable to existing toilet seats and be secured once positioned on the toilet seat.

SUMMARY OF THE INVENTION

The present invention meets the needs presented above by generally comprising a panel that has a top side, a bottom side, a forward edge and a rear edge. The rear edge is concavely arcuate between opposite ends of the rear edge. The rear edge is contoured to an outer edge of a toilet seat. A pair of gripping members is provided. Each of the gripping members is coupled to the panel and releasably couples the panel to the toilet seat. The panel extends outwardly from the outer edge of the toilet seat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top perspective view of a toilet seat gripping apparatus according to the present invention.

FIG. 2 is a bottom perspective view of the present invention.

DESCRIPTION OF THE PREFERRED EMBODIMENT

Figure 5:
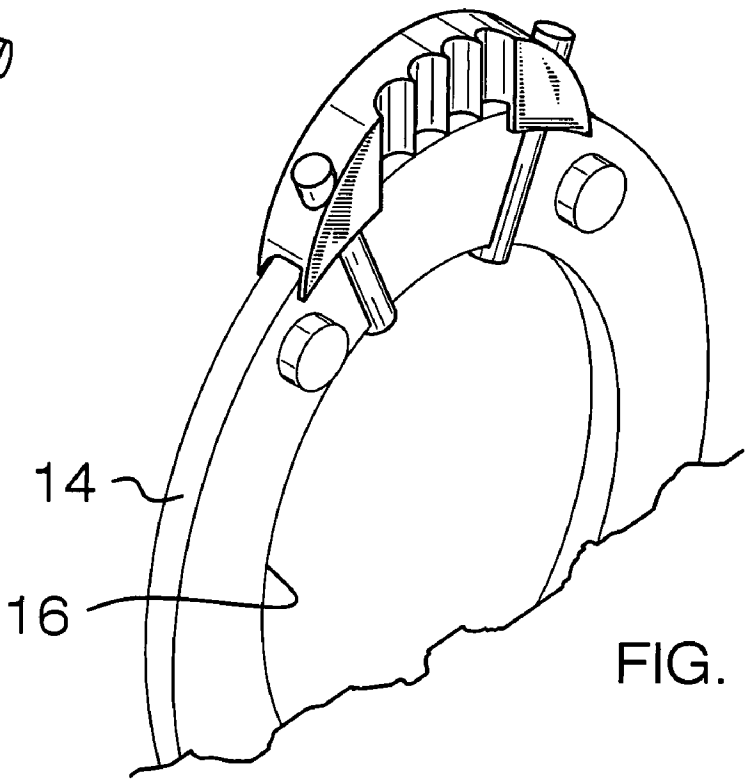
FIG. 5 is a bottom perspective in-use view of the present invention.
Figure 3:
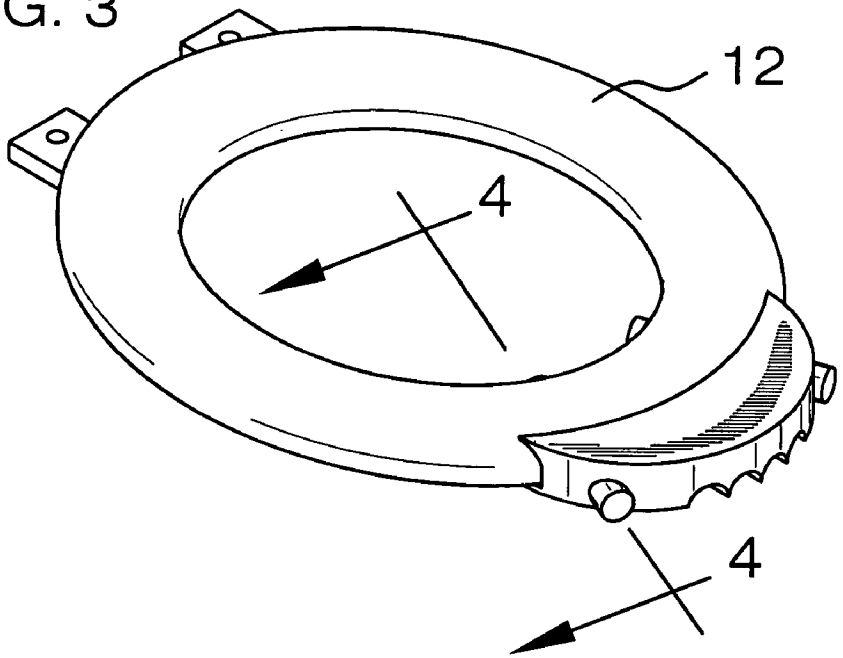
FIG. 3 is a top perspective in-use view of the present invention.
Figure 4:
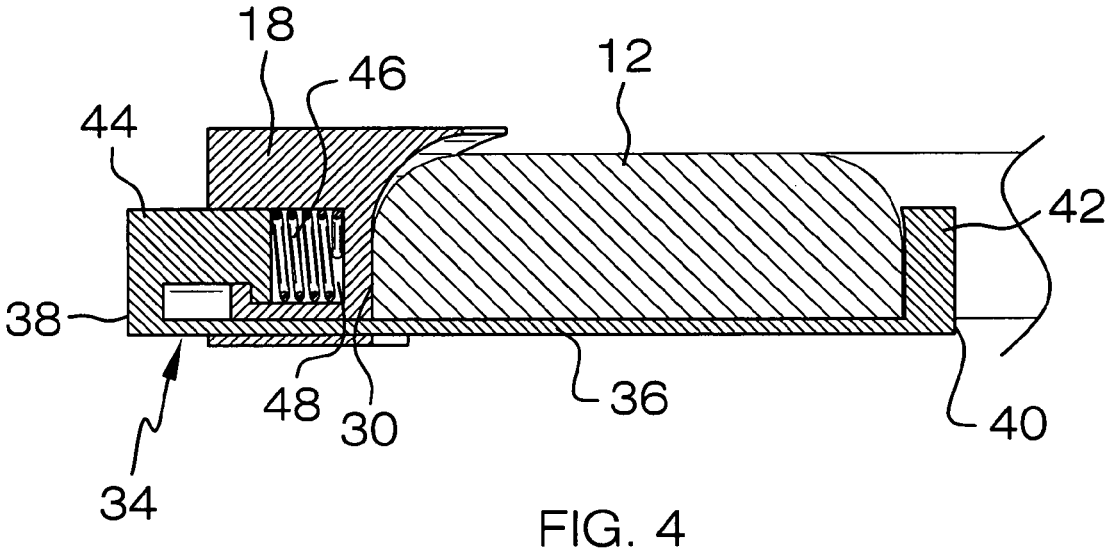
FIG. 4 is a cross-sectional view taken along line 4-4 of FIG. 3 of the present invention.

With reference now to the drawings, and in particular to FIGS. 1 through 5 thereof, a new toilet seat grip embodying the principles and concepts of the present invention and generally designated by the reference numeral 10 will be described.

As best illustrated in FIGS. 1 through 5, the toilet seat gripping apparatus 10 is configured to engage a toilet seat 12. The toilet seat 12 has an outer edge 14 and an inner edge 16. The apparatus 10 generally comprises a panel 18 that has a top side 20, a bottom side 22, a forward edge 24 and a rear edge 26. The rear edge 26 is concavely arcuate between opposite ends 28 of the rear edge 26. The rear edge 26 is contoured to the outer edge 14 of the toilet seat 12. The rear edge 26 has a slot 30 therein extending between the opposite ends 28. The outer edge 14 is removably extended into the slot 30. The bottom side 22 has a plurality of finger grooves 32 therein. Each of the grooves 32 extends from the forward edge 24 to the rear edge 26. The forward edge 24 is convexly arcuate.

A pair of gripping members 34 is provided. Each of the gripping members 34 is coupled to the panel 18 and releasably couples the panel 18 to the toilet seat 12. The panel 18 extends outwardly from the outer edge 14 of the toilet seat 12. Each of the gripping members 34 comprises an elongated member 36 that has a first end 38 and a second end 40. The elongated member extends through the panel 18. The first end 38 extends away from the forward edge 24 and the second end 40 extends away from the rear edge 26. A catch 42 is attached to and extends upwardly from the second end 40 of the elongated member 36. An actuator 44 is attached to the first end 38. A biasing member 46 biases the actuator 44 away from the forward edge 24 and biases the catch 42 toward the rear edge 26. The actuator 44 extends into a well 48 in the forward edge 24. The actuator 44 may be pressed into the well 48 to move the catch 44 away from the rear edge 26. The toilet seat 12 is positioned between the catch 42 and the rear edge 26 of the panel 18 to urge the outer edge 14 into the slot 30.

In use, the gripping members 34 are used to attach the panel 18 to the toilet seat 12 as shown in FIG. 5 and described above. The panel 18 may then be used to lift the toilet seat 12 so that the toilet seat 12 itself does not have to be touched. The gripping members 34 need not be used wherein the slot 30 simply receives the outer edge 14 of the toilet seat 12 and the user biases the rear edge 26 against the outer edge 14 as the toilet seat 12 is lifted.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet seat gripping and lifting apparatus for engaging a toilet seat, the toilet seat having an outer edge and an inner edge, said assembly comprising:

a panel having a top side, a bottom side, a forward edge and a rear edge, said rear edge being concavely arcuate between opposite ends of said rear edge, wherein said rear edge is contoured to the outer edge of the toilet seat, said bottom side of said panel having a plurality of finger grooves therein, each of said grooves extending from said forward edge to said rear edge; and a pair of gripping members, each of said gripping members being coupled to said panel and releasably coupling said panel to the toilet seat, said panel extending outwardly from the outer edge of the toilet seat.

2. The apparatus according to claim 1, wherein said rear edge has a slot therein extending between said opposite ends, the outer edge being removably extended into said slot.

3. The apparatus according to claim 1, wherein each of said gripping members comprises:

an elongated member having a first end and a second end, said elongated member extending through said panel, said first end extending away from said forward edge and said second end extending away from said rear edge;

a catch being attached to and extending upwardly from said second end of said elongated member;

an actuator being attached to said first end; and a biasing member biasing said actuator away from said forward edge and biasing said catch toward said rear edge, the toilet seat being positioned between the catch and the rear edge of the panel.

4. A toilet seat gripping and lifting apparatus for engaging a toilet seat, the toilet seat having an outer edge and an inner edge, said assembly comprising:

a panel having a top side, a bottom side, a forward edge and a rear edge, said rear edge being concavely arcuate between opposite ends of said rear edge, wherein said rear edge is contoured to the outer edge of the toilet seat, said rear edge having a slot therein extending between said opposite ends, the outer edge being removably extended into said slot, said bottom side having a plurality of finger grooves therein, each of said grooves extending from said forward edge to said rear edge, said forward edge being convexly arcuate;

a pair of gripping members, each of said gripping members being coupled to said panel and releasably coupling said panel to the toilet seat, said panel extending outwardly from the outer edge of the toilet seat, each of said gripping members comprising:

an elongated member having a first end and a second end, said elongated member extending through said panel, said first end extending away from said forward edge and said second end extending away from said rear edge;

a catch being attached to and extending upwardly from said second end of said elongated member;

an actuator being attached to said first end; and a biasing member biasing said actuator away from said forward edge and biasing said catch toward said rear edge, the toilet seat being positioned between the catch and the rear edge of the panel.

5. A toilet seat gripping and lifting apparatus for engaging a toilet seat, the toilet seat having an outer edge and an inner edge, said assembly comprising:

a panel having a top side, a bottom side, a forward edge and a rear edge, said rear edge being concavely arcuate between opposite ends of said rear edge, wherein said rear edge is contoured to the outer edge of the toilet seat; and a pair of gripping members, each of said gripping members being coupled to said panel and releasably coupling said panel to the toilet seat, said panel extending outwardly from the outer edge of the toilet seat; each of said gripping members comprising;

an elongated member having a first end and a second end, said elongated member extending through said panel, said first end extending away from said forward edge and said second end extending away from said rear edge;

a catch being attached to and extending upwardly from said second end of said elongated member;

an actuator being attached to said first end; and a biasing member biasing said actuator away from said forward edge and biasing said catch toward said rear edge, the toilet seat being positioned between the catch and the rear edge of the panel.

6. The apparatus according to claim 5, wherein said rear edge has a slot therein extending between said opposite ends, the outer edge being removably extended into said slot.

* * * * *